US012439960B2

(12) United States Patent
Davis et al.

(10) Patent No.: US 12,439,960 B2
(45) Date of Patent: Oct. 14, 2025

(54) DUAL-PURPOSE GLASS CONTAINER FOR STORING AND SMOKING GROUND PLANT MATTER

(71) Applicant: Pre-Pack, Inc., Narragansett, RI (US)

(72) Inventors: Austin G. Davis, Narragansett, RI (US); Jeffrey LeBlanc, East Greenwich, RI (US)

(73) Assignee: Pre-Pack, Inc., Narragansett, RI (US)

( * ) Notice: Subject to any disclaimer, the term of this patent is extended or adjusted under 35 U.S.C. 154(b) by 206 days.

(21) Appl. No.: 17/516,220

(22) Filed: Nov. 1, 2021

(65) Prior Publication Data

US 2022/0132915 A1 May 5, 2022

Related U.S. Application Data

(60) Provisional application No. 63/204,861, filed on Nov. 2, 2020.

(51) Int. Cl.

| | |
|---|---|
| ***A24F 3/00*** | (2006.01) |
| ***A24F 1/28*** | (2006.01) |
| ***A24F 5/10*** | (2006.01) |
| ***A24F 23/00*** | (2006.01) |
| ***B65D 43/02*** | (2006.01) |

(52) U.S. Cl.

CPC ..... *A24F 3/00* (2013.01); *A24F 1/28* (2013.01); *A24F 5/10* (2013.01); *A24F 23/00* (2013.01); *B65D 43/022* (2013.01)

(58) Field of Classification Search

USPC ..... 131/180

See application file for complete search history.

(56) References Cited

U.S. PATENT DOCUMENTS

| | | | | |
|---|---|---|---|---|
| 10,021,906 | B2 * | 7/2018 | Cyphert | A24F 3/00 |
| 10,258,080 | B2 * | 4/2019 | Barrett | A24F 1/02 |
| 2011/0197903 | A1 * | 8/2011 | Patel | A24F 13/06 131/192 |
| 2018/0000154 | A1 * | 1/2018 | Morgan | A24F 1/08 |
| 2022/0132915 | A1 * | 5/2022 | Davis | A24F 5/10 131/180 |
| 2023/0210167 | A1 * | 7/2023 | Lerner | A24F 5/10 131/181 |

FOREIGN PATENT DOCUMENTS

| | | | | |
|---|---|---|---|---|
| WO | WO-2025052299 | A1 * | 3/2025 | A61M 15/0003 |

OTHER PUBLICATIONS

Amazon et al. (Plastic Round Tube Ribbed Inserts End Cover Cap; Manufactured Date: Jul. 16, 2018). (Year: 2018).*

* cited by examiner

*Primary Examiner* — Philip C Tucker

(74) *Attorney, Agent, or Firm* — Hinckley, Allen & Snyder, LLP; David R. Josephs

(57) ABSTRACT

The device includes a single piece of glass configured into smokable plant matter chamber, venturi structure and smoke chamber along with a sealing cap with at least one fin and a lower plug portion. The smoke chamber includes an orifice by which the user draws the smoke after combustion of the smokable plant matter in the smokable plant matter chamber that acts as a bowl for holding smokable plant matter during combustion. A cap is provided to close and seal the smokable plant matter chamber after it is filled with ground smokable plant matter and to pack and seal the ground smokable plant matter in a desire amount of compression. If the user does not consume all of the ground smokable plant matter during use, the cap can be re-inserted, and the user can store and transport the remainder of the ground smokable plant matter for subsequent use.

8 Claims, 7 Drawing Sheets

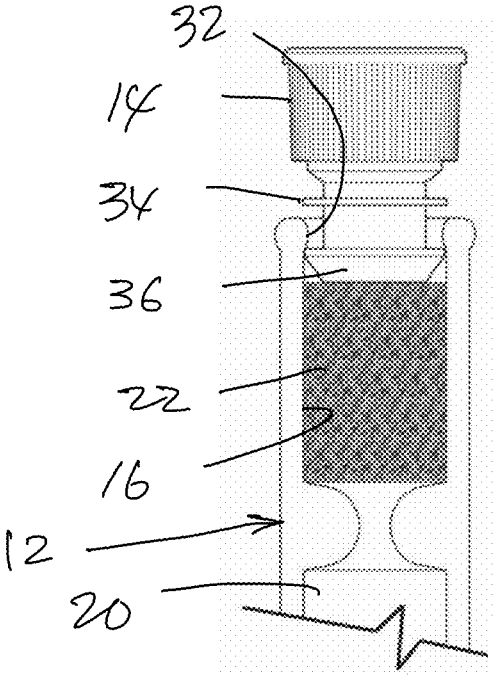
FIG. 12A
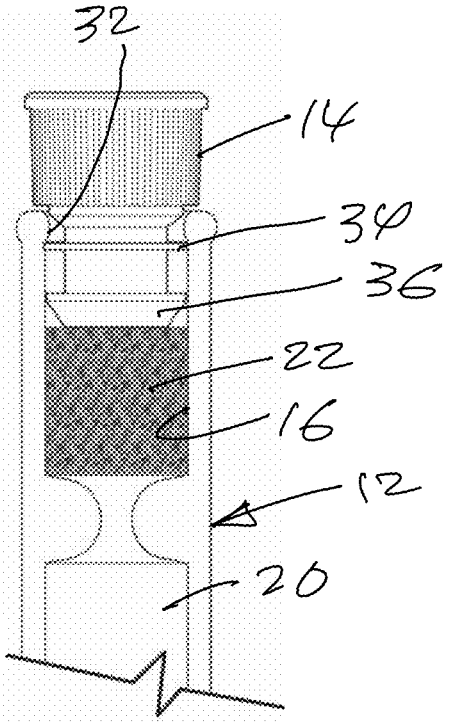
FIG. 12B
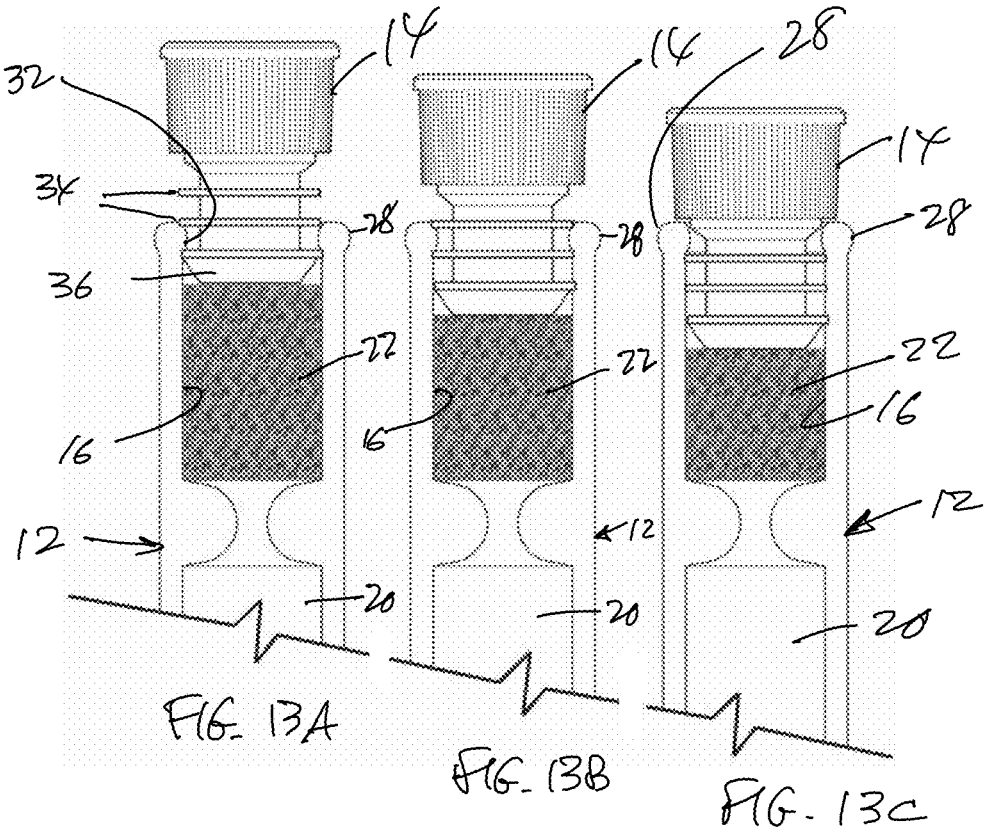
FIG. 13A
FIG. 13B
FIG. 13C

DUAL-PURPOSE GLASS CONTAINER FOR STORING AND SMOKING GROUND PLANT MATTER

CROSS REFERENCE TO RELATED APPLICATIONS

This application is related to, and claims benefit from, U.S. Provisional Application No. 63/204,861, filed on Nov. 2, 2020, entitled "DUAL PURPOSE GLASS CONTAINER FOR STORING AND SMOKING GROUND PLANT MATTER," incorporated by reference in its entirety, herein.

BACKGROUND OF THE INVENTION

The present invention generally relates to the manufacture of smoking products. The present invention is applicable to all industries that utilize herbal material, including but not limited to tobacco, spices, and ground smokable plant matter.

As a means for consuming such materials, people have adopted the practice of smoking, wherein the material is burned to produce inhalable smoke. Humans have created a variety of devices to facilitate smoking, such as pipes or hookahs, but many prefer the convenience of carrying the ground smokable plant matter in the same device as the device they use for smoking the plant matter. Currently, to achieve the convenience of carrying the ground smokable plant matter in the same device that will be used to smoke the ground smokable plant matter, one must purchase the ground smokable plant matter and device separately and thereafter must manually fill and cap the device. The user must pre-measure and weigh the ground smokable plant matter prior to filling the device in order to determine how much ground smokable plant matter is packed in the device.

There have been attempts in the prior art to address the foregoing known problems in the industry. For example, there have been attempts to sell pre-filled smoking devices but they inadequately store the smokable plant matter and/or the smoking device itself is too large or cumbersome to use.

For the foregoing reasons, there is a need for an effective smoking device that can not only be used for smoking the smokable plant matter but also to store the smokable plant matter during transport and sale.

SUMMARY OF THE INVENTION

The dual-purpose glass container used for storing and smoking ground smokable plant matter of the present invention is specially configured and manufactured to a specific size and shape which are critical to its use, ergonomics, compatibility with common child-resistant packaging and mass production with very tight tolerances to ensure a large number of units can be filled at one time using a specially designed filling system and capping system to ensure each unit holds, packs and stores a specific amount of ground smokable plant matter. As a result, the device of the present invention allows businesses to efficiently fill and cap large quantities at a time and in turn sell the prefilled units with a specific amount of ground smokable plant matter. This permits the user to purchase a pre-filled glass container that can be immediately used as a smoking device, namely a pipe.

The device of the present invention consists of a single piece of glass configured into three distinct sections and a sealing cap. The dual-purpose glass container used for storing and smoking ground smokable plant matter includes a smokable plant matter chamber and a smoke chamber connected by a venturi. The smoke chamber includes an orifice by which the user draws the smoke. The smokable plant matter chamber, which also acts as a bowl for holding smokable plant matter during combustion and smoking, has an open end. A cap is provided to close the smokable plant matter chamber after it is filled with ground smokable plant matter and to pack and seal the ground smokable plant matter.

In accordance with the present invention, a large number of the dual-purpose glass containers used for storing and smoking ground plant matter can be filled with ground smokable plant matter using a specially designed filling system configured to work exclusively with the rolled outer edge of the present invention. After filling, caps are inserted using a capping system configured to work exclusively with the rolled outer edge of the present invention. The caps pack and seal the ground smokable plant matter, which facilitate the sale, transit, storage, and re-use by the consumer.

When a user desires to smoke the ground smokable plant matter, the cap is removed, and the ground smokable plant matter is exposed and then combusted using a flame while air is drawn through the orifice on the opposing side. If the user does not consume all of the ground smokable plant matter during that use, the cap can be re-inserted, and the user can store and transport the remainder of the ground smokable plant matter for subsequent use.

Therefore, it is an object of the present invention to provide a smoking devices that is pre-filled with an amount of smokable plant matter.

There is a further object of the present invention to provide a dual-purpose smoking device that can store the smokable plant matter when the device is not being used to smoke the smokable plant matter, such as during transport, storage and display for sale.

BRIEF DESCRIPTION OF THE DRAWING FIGURES

The novel features that are characteristic of the present disclosure are set forth in the appended claims. However, the disclosure's preferred embodiments, together with further objects and attendant advantages, will be best understood by reference to the following detailed description taken in connection with the accompanying drawings in which:

Figure 14:
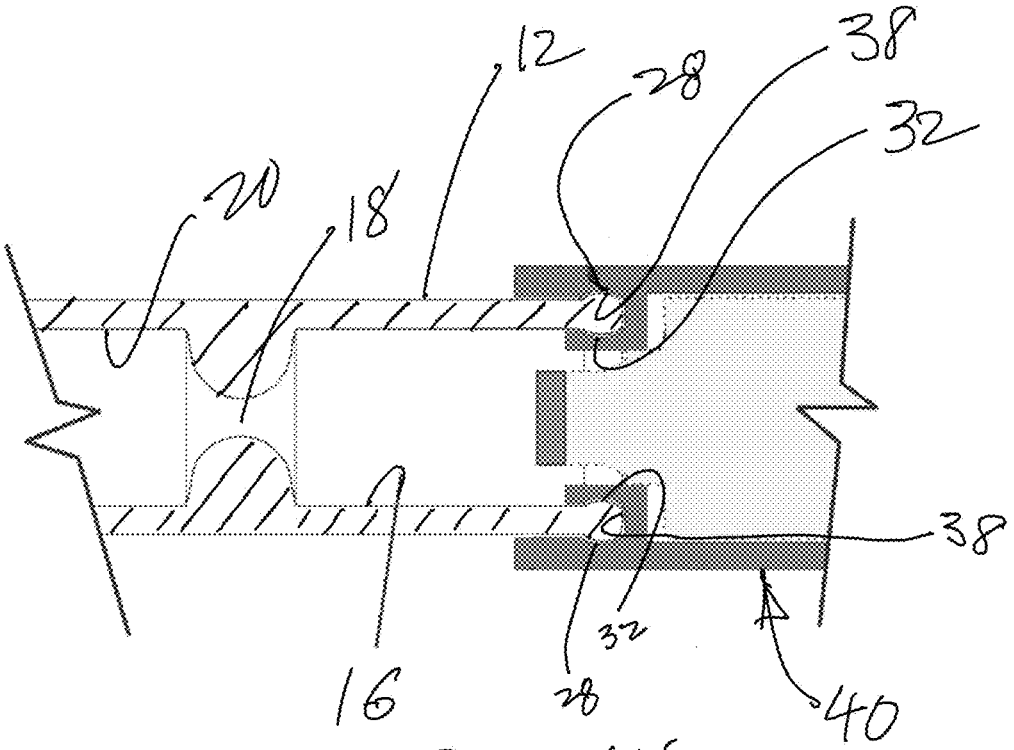
Figure 15:
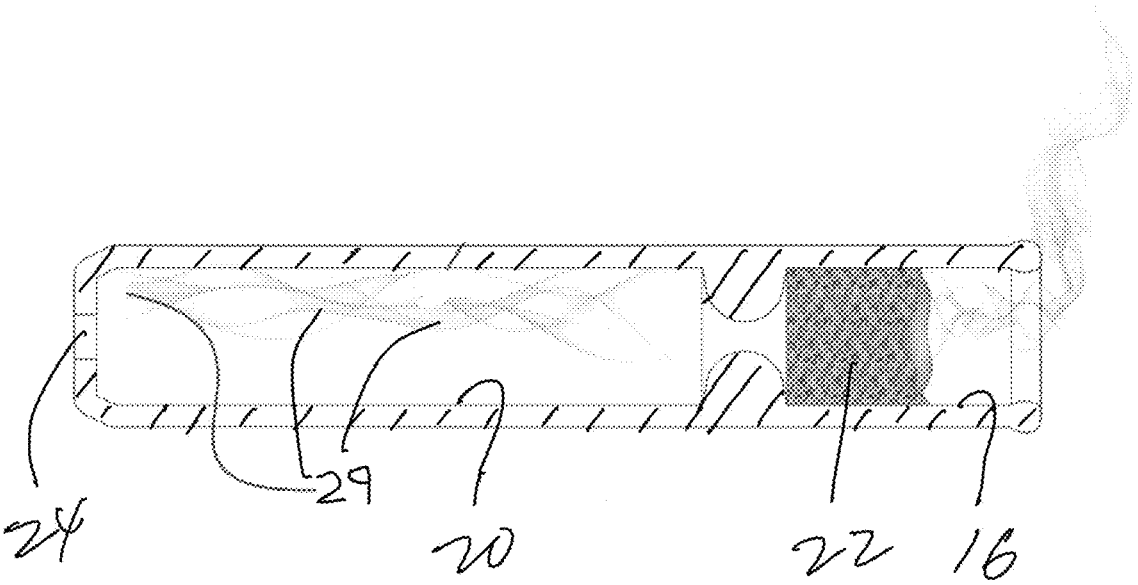
Figure 16:
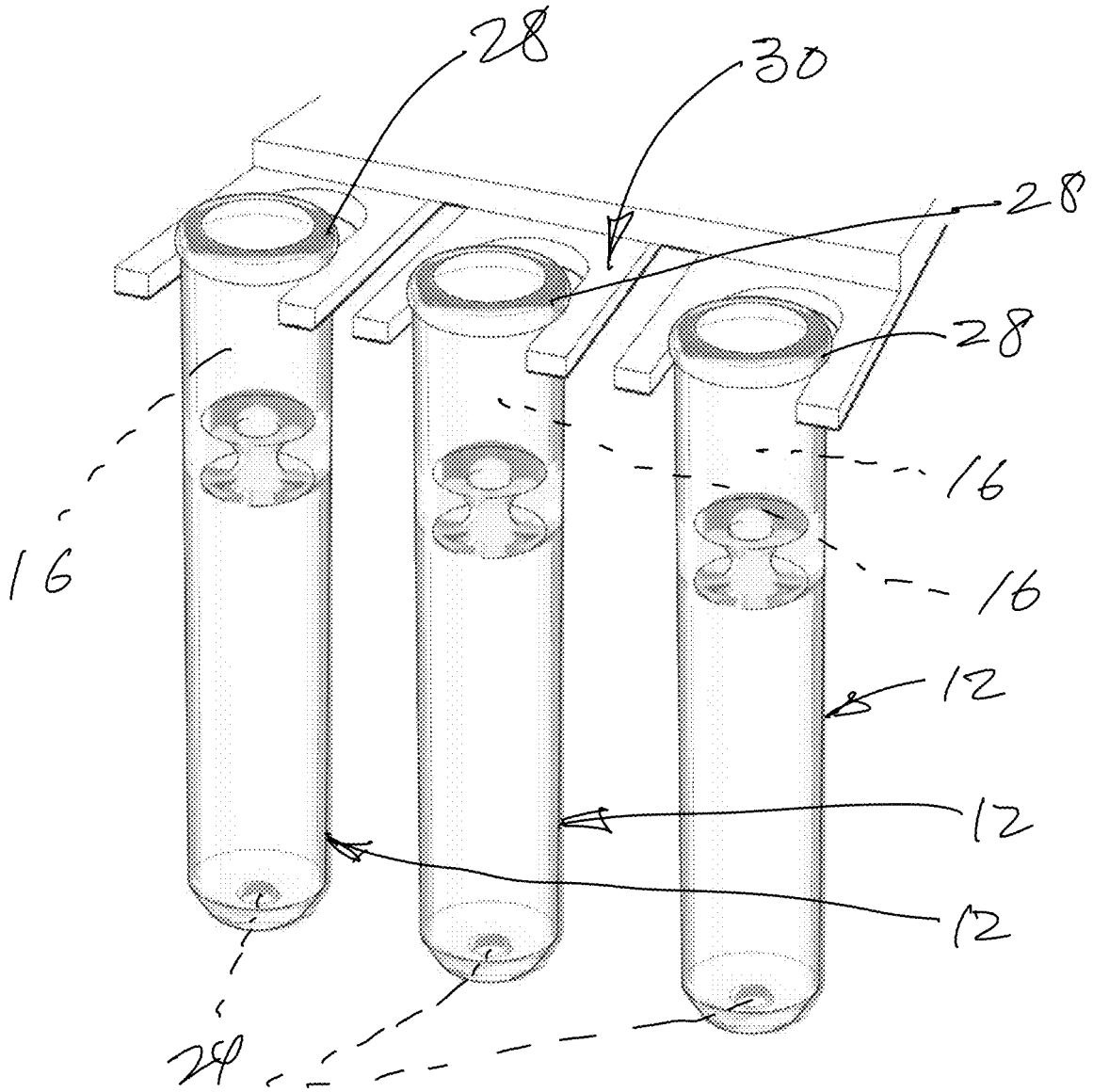

FIGS. 12A-B shows a two-stage compression installation of the cap into the chamber end of the device;

FIGS. 13A-C shows a three-stage compression installation of the cap into the chamber end of the device;

FIG. 14 shows a side partial, cross-sectional view of docking and sealing of a heat source to the device;

FIG. 15 is a side, partial cross-sectional view of the smokable plant matter being smoked using the device of the present invention; and FIG. 16 is a perspective view of the use of the rolled outer edge as a carry point in the manufacturing process.

DESCRIPTION OF THE INVENTION

Certain exemplary embodiments will now be described to provide an overall understanding of the principles of the structure, function, manufacture, and use of the device and methods disclosed herein. One or more examples of these embodiments are illustrated in the accompanying drawings. Those skilled in the art will understand that the devices and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present disclosure. Further, in the present disclosure, like-numbered components of the embodiments generally have similar features, and thus within a particular embodiment each feature of each like-numbered component is not necessarily fully elaborated upon. Additionally, to the extent that linear or circular dimensions are used in the description of the disclosed systems, devices, and methods, such dimensions are not intended to limit the types of shapes that can be used in conjunction with such systems, devices, and methods. A person skilled in the art will recognize that an equivalent to such linear and circular dimensions can easily be determined for any geometric shape. Further, to the extent that directional terms like proximal, distal, top, bottom, up, or down are used, they are not intended to limit the systems, devices, and methods disclosed herein. A person skilled in the art will recognize that these terms are merely relative to the system and device being discussed and are not universal.

The dual-purpose glass container 10 of the present invention is used for storing and smoking ground plant matter is specially configured and manufactured to a specific size and shape such that it can be mass produced with very tight tolerances to ensure a large number of units can be filled at one time using a specially designed filling system and capping system to ensure each unit holds, packs and stores a specific amount of ground smokable plant matter 22. As a result, the device 10 of the present invention allows businesses, such a manufacturers, to efficiently fill and cap large quantities at a time and in turn sell the prefilled units with a specific amount of ground smokable plant matter 22.

Figure 1:
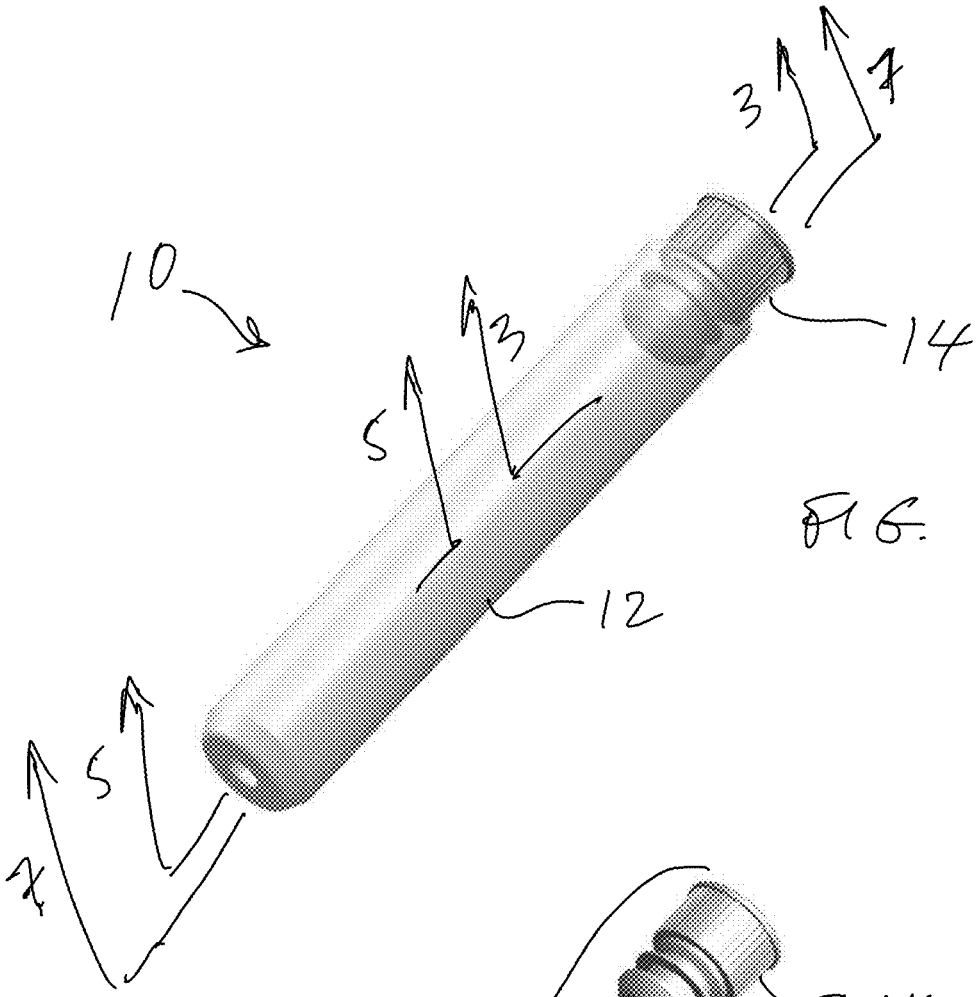
FIG. 1 shows a perspective of the dual-purpose glass container device of the present invention.
Figure 2:
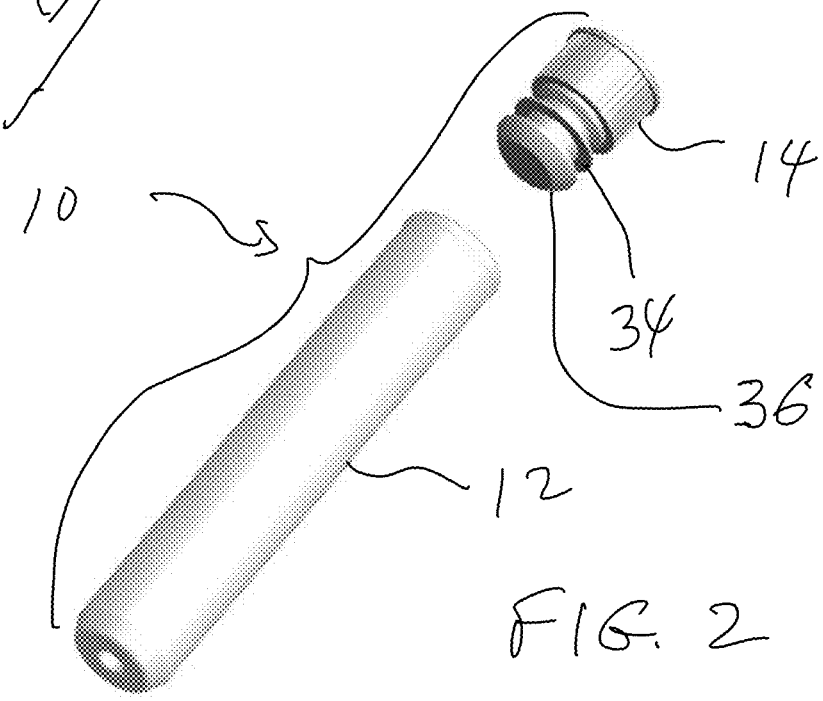
FIG. 2 shows an exploded perspective view of the device of FIG. 1.
Figure 3:
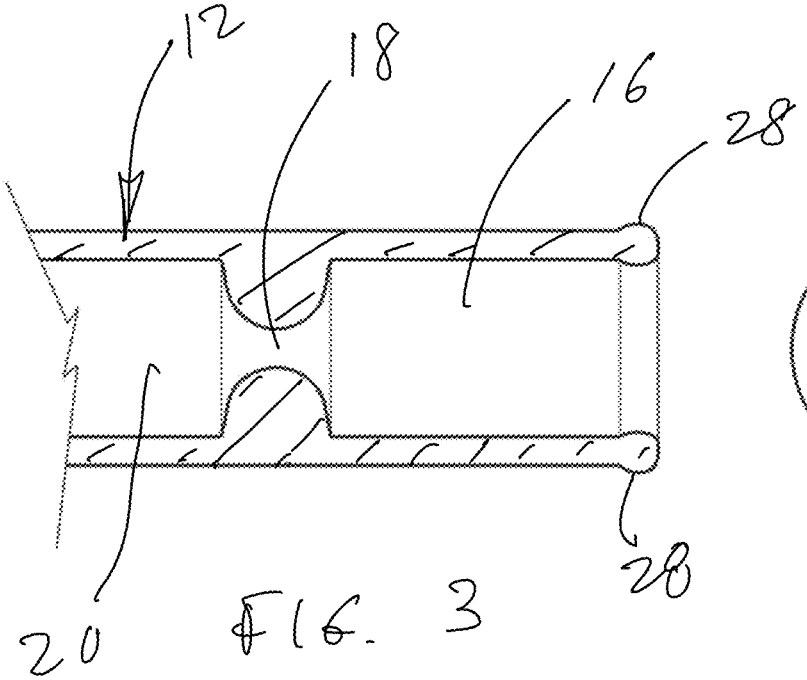
FIG. 3 shows a cross-sectional view through the line 3-3 of FIG. 1.
Figure 4:
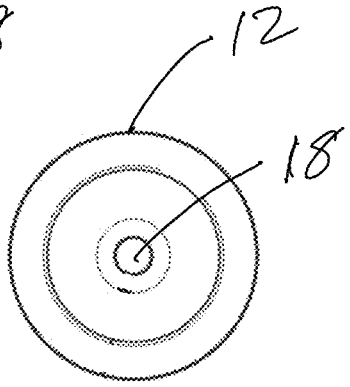
FIG. 4 is an end view of the chamber end of the device of FIG. 1.

Turning first to FIGS. 1 and 2, the present invention includes a main body 12 in the form of a single piece of preferably rigid material, such as glass, and a frictional sealing cap 14. A close-up cross-sectional view of the smokable plant matter chamber 16 and venturi portion 18 of the device 10 is shown in FIG. 3 while an end view of the smokable plant matter chamber 16 is shown in FIG. 4. A close-up cross-section view of the smoke chamber 20 and inhalation orifice 24 of the device is shown in FIG. 5 while and end view of the orifice 24 of the device 10 is shown in FIG. 6.

In FIGS. 7-10, the different components and sections of the device of the present invention can be clearly seen. The device is configured into three distinct sections, namely, a smoke chamber, a venturi portion and a smokable plant matter chamber. The first section of the device is a topmost smokable plant matter chamber. This smokable plant matter chamber is preferably manufactured: (a) to a specific size such that it preferably holds between 0.10 and 0.55 grams of smokable plant matter; (b) with a specific size rolled outer edge with a slight taper; and (c) with an inner lip. The rolled outer edge and inner lip are essential to the effectiveness of the sealing cap and the use of proprietary filling and capping systems, as will be described in detail below.

Figure 7:
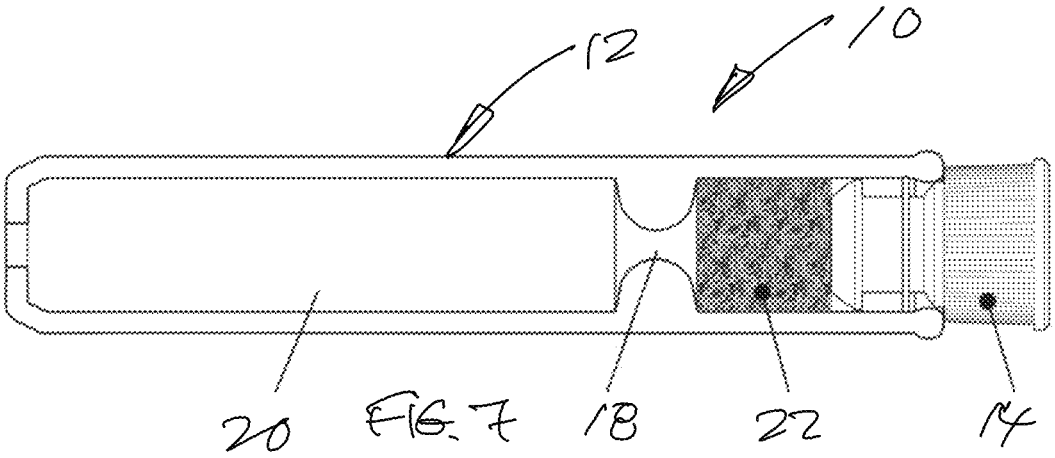
FIG. 7 is a partial cross-sectional view through the line 7-7 of FIG. 1.
Figure 8:
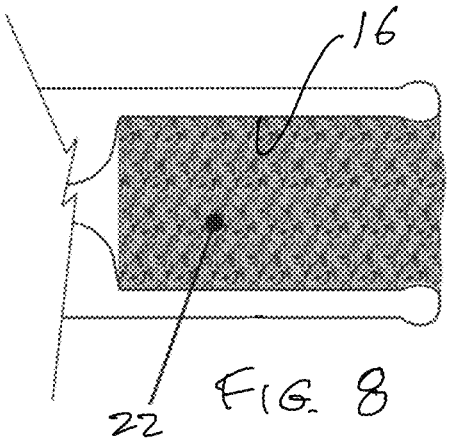
FIG. 8 is a close-up view of the chamber end of the view of FIG. 7.
Figure 9:
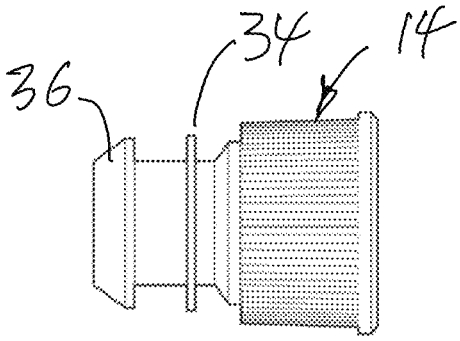
FIG. 9 is a side elevational view of the cap.

As best seen in FIG. 7 and close-up on FIGS. 3 and 4, the second section of the dual-purpose glass container of the present invention is a venturi structure. This venturi structure 18 is configured to a specific diameter such that ground smokable plant matter 22 will not pass through and provides for an optimal draw of smoke.

Figure 6:
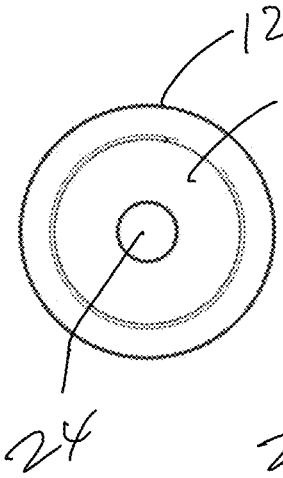
FIG. 6 is an end view of the orifice intake end of the device of FIG. 1.
Figure 5:
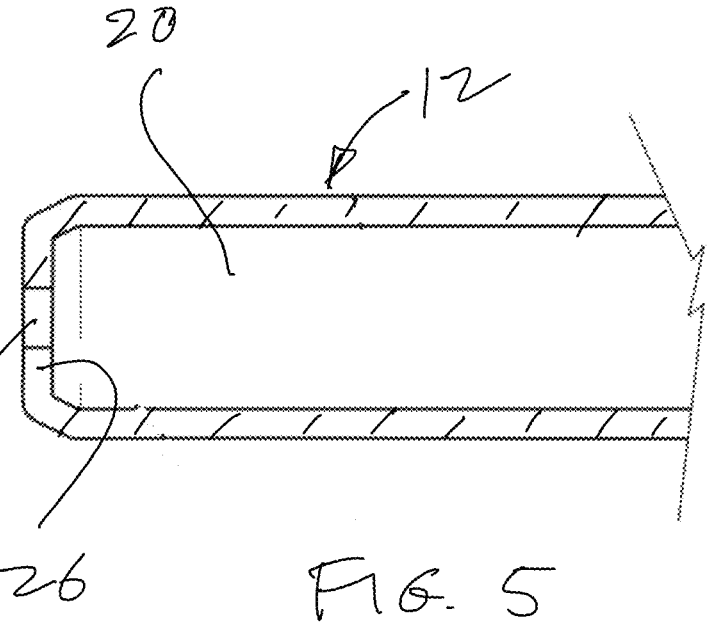
FIG. 5 shows a cross-sectional view through the line 5-5 of FIG. 1.

As also seen generally in FIG. 7 and close-up in FIGS. 5 and 6, the third section of the dual-purpose glass container 10 of the present invention is the bottom chamber 20, also referred to as the smoke chamber. The smoke chamber 20 is configured using a back wall 26 that includes a small orifice port 24. The back wall 26 is configured to trap particulate so that when a user draws on the smoke chamber 20 via the orifice port 24, an optimal amount of smoke without any particulate is achieved. In addition, the configuration of the small orifice 24 and backwall 26 also help to contain residual smoke 29 not ingested by a user during an initial inhalation. As illustrated in FIG. 15, this entrapment of residual smoke 29 allows a user to go back for a second inhalation so that no smoke is wasted.

Figure 10:
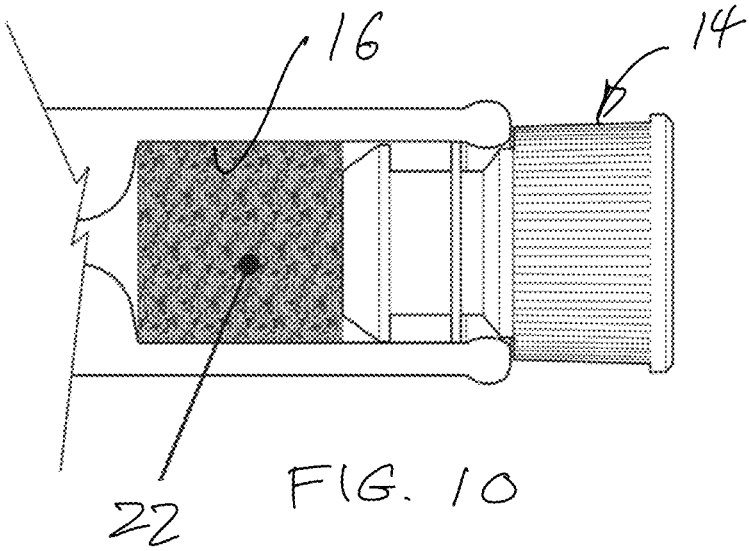
FIG. 10 is a close-up partial cross-sectional view of the chamber end of the device loaded with smokable plant matter with cap installed.

The cap 14 is used to compress or pack the ground smokable plant matter 22 to the optimal density and to create a seal that keeps the ground plant matter dry, fresh, and secure, as generally shown in FIG. 10. Multi-stage compression of smokable plant matter 22 within the smokable plant matter chamber 16 is shown in FIGS. 12A-B and 13A-C, as discussed in detail below.

The rolled outer edge is a critical component for child resistant cap designs. The rolled outer edge 28 also acts as a hold or carry point while moving through the manufacturing process, as can be seen in FIG. 16, where the rolled outer edge 28 enables a device 10 to be hung from a fork-like support 30. This enables the open smokable plant matter chamber 16 to be positioned on top so the subsequent loading of smokable plant matter 22 therein can be easily carried out with the assistance of gravity.

Figure 11:
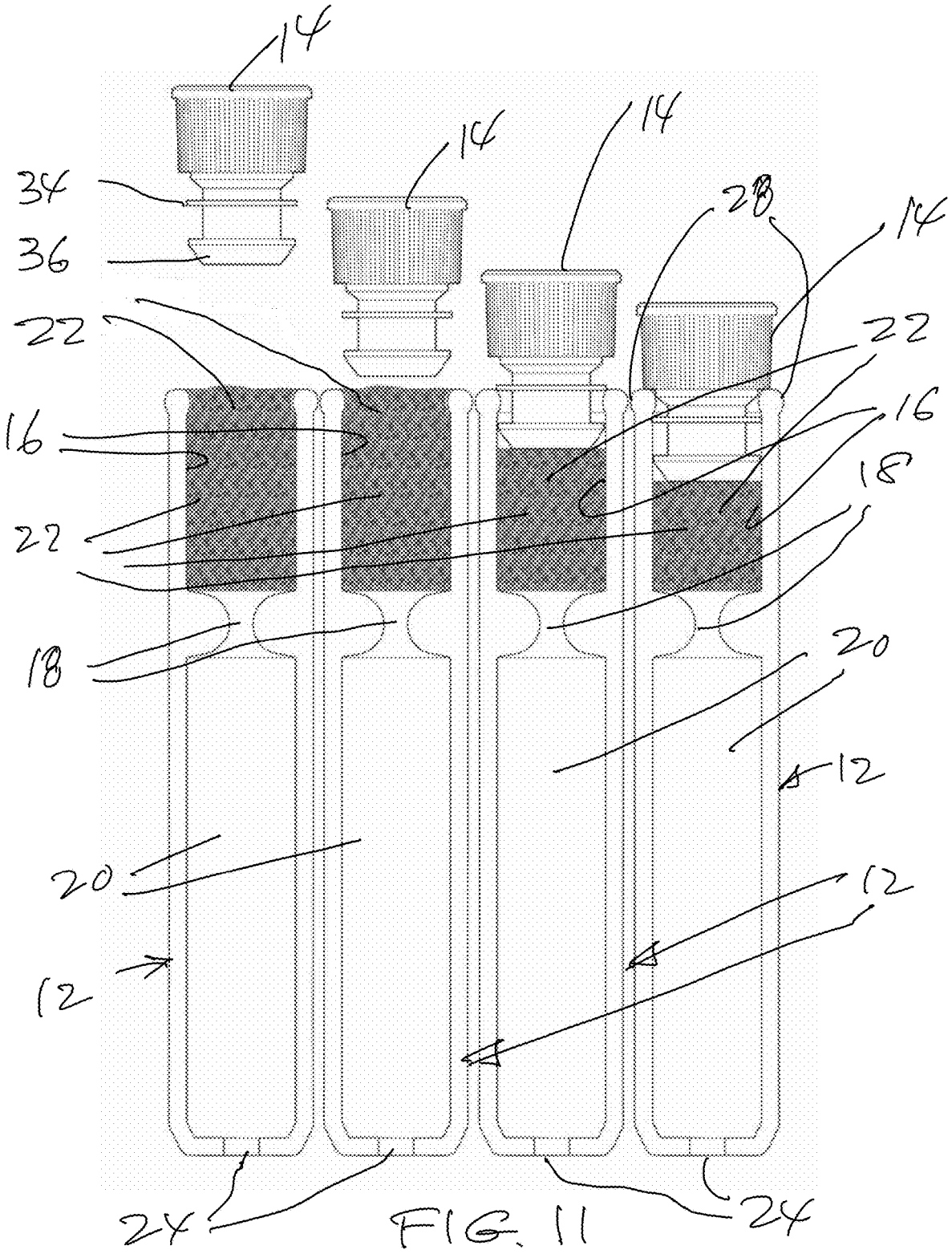
FIG. 11 is a side partial cross-sectional view of an array of a number of devices of the present invention.

Also, as in FIG. 11, the rolled outer edge 28 serves as a spacing element between the dual-purpose glass containers 10 when organized into a matrix used in the filling, storing, and shipping processes, such as when multiple container devices 10 are loaded into a storage box (not shown). Further, the rolled outer edge 28 also prevents the dual-purpose glass containers 10 from rolling in a straight path, thereby reducing the chance that the dual-purpose glass containers will unintentionally roll and fall off an elevated surface.

As shown in FIGS. 12A-B and 13A-C, the inner lip 32 of the device of the present invention enables for multi-stage sealing installation of the cap 14 into the smokable plant matter chamber 16 of the device 10. The multi-stage sealing cap 14 allows for varying levels of compression of plant matter 22 thereby providing greater flexibility as to the amount of plant matter 22 to be stored and packed in the chamber 16. More specifically, the cap 14 is provided with a number of spaced apart, preferably circumferential flexible fins 34 and a lower plug portion 36.

FIGS. 12A-B shows a two-stage compression installation of the cap 14 with a single fin 34 and the lower plug portion 36. In FIG. 12A, the cap 14 is first depressed downwardly so the lower plug 36 first clears the inner lip 32 to start the compression of the smokable plant matter 22 while the peripheral edge 36*a* of the lower plug 36 contacts the inner wall of the smokable plant matter chamber 16. Then, in FIG. 12B, the cap 14 is pressed further downwardly so the fin 34 now clears downwardly past the inner lip 32 in order for the outer periphery of the fin 34 to now contact the inner surface of the smokable plant matter chamber 16 thereby providing a second level of compression of the smokable plant matter 22 while the cap 14 is frictionally retained in place.

In FIGS. 13A-C, a three-stage compression installation of the cap 14 with two fins 34 and the lower plug portion 36. In FIG. 13A, the cap 14 is first depressed downwardly so the lower plug 36 first clears the inner lip 32 to start the compression of the smokable plant matter 22 while the peripheral edge 36*a* of the lower plug 36 contacts the inner wall of the smokable plant matter chamber 16. Then, in FIG. 13B, the cap 14 is pressed further downwardly so the lower (first) fin 34 now clears downwardly past the inner lip 32 in order for the outer periphery of the lower (first) fin 34 to now contact the inner surface of the smokable plant matter chamber 16 thereby providing a second level of compression of the smokable plant matter 22 while the cap 14 is frictionally retained in place. As in FIG. 13C, the cap 14 is pressed even further downwardly so the upper (second) fin 34 now contacts the inner surface of the smokable plant matter chamber 16 thereby providing third level of compression of the smokable plant matter 22 while the cap 14 is still remaining in frictional engagement with the inner wall of the smokable plant matter chamber 16. Therefore, the inner lip 32 provides a bead-like structure that can ride over the fins 34 and rest in between fins 34 or between a fin 34 and the lower plug portion 36 for indexed-like control of the compression of the smokable plant matter 22 within the smokable plant matter chamber 16. It should be noted that it is possible for provide more than two fins 34 may be provided on the cap 14 for further control of the compression of the smokable plant matter 22. Also, the size and shape of the inner lip 32 and the number, spacing and size of the fin 34 or fins 34 may be modified to suit the desired compression capabilities of the device 10 of the present invention.

In addition, the inner lip 32 is also a critical component for child resistant multi-action cap designs. The inner lip 32 creates a slight tapered area leading to the smokable plant matter chamber 16, making the filling process more efficient and consistent while reducing waste.

As shown in FIG. 14, the rolled outer edge 28 and inner lip 32 are essential components for docking the dual-purpose glass container 10 with a heat/ignition source, generally referred to as 40, for combusting and then smoking of the smokable plant matter 22. The smokable plant matter chamber 16 is configured to fit over a heating/ignition element of a heat source 40 in an example type of heater 40 shown in FIG. 14. The rolled edge 28, 32 of the dual-purpose glass container 10 fits inside the attachment and sealing seat 38 of the heat/ignition source 40, thereby creating a seal and holding in place the dual-purpose glass container 12 and heat source 40. This allows the heating element to remain sheathed but still contacting and/or able to vaporize the ground plant matter 22 within the smokable plant matter chamber 16.

Therefore, the present invention provides a glass container 12 with a cap 14 that can be used for transporting, storing and smoking ground plant matter 22 and that can be manufactured to specific dimensions in mass. The device 10 enables a consistent manufacture and fill each container with a specific amount of material 22 and to materially reduce waste. Moreover, the present invention provides branding opportunities by affixing custom labels to the exterior of the device 10. Moreover, the device 10 of the present invention facilitates the use of a portion of the ground smokable plant matter 22 by permitting the container to be re-capped to contain the remaining portion of the smokable plant matter 22 for use at another time. The present invention 10 enables the smokable plant matter 22 to be compressed/packed in the container 10 to the optimal density for use and storage. The container device 10 of the present invention provides the perfect draw of smoke while preventing particulate to pass through to the user.

The main body 12 of the device 10 of the present invention is preferably made of glass but may be any other material that is suitable for safely containing smokable plant matter 22 and for exposure to heat during a smoking operation. The cap 14 is preferably made of molded plastic but may be made of any other material that is capable of the desired sealing and compression operations. The entire device 10 of the present invention may be configured in any dimensions but various dimensions are preferred to provide a desired smokable plant matter chamber 16 storage size and smoke chamber size for suitable smoking characteristics and for overall size for desired portability. As one example, the entire device 10, including the cap 14, may be 91.75 mm long and 15.5 mm in diameter. The main body portion 12 may be 80.0 mm long. The inner diameter of the venturi structure 18 may be 2.0 mm while the intake orifice 24 is 3.75 mm in diameter. The smoke chamber 20 may be 49.5 mm long and the smokable plant matter chamber 16 may be 21.0 mm long. The longitudinal distance of the venturi structure 18 may be 9.0 mm long. The inner diameter of the smoke chamber 20 and the smokable plant matter chamber 16 may be 11.0 mm in diameter. The walls of the main body 12 are preferably 1.8 mm thick.

It will be appreciated by those skilled in the art that various changes and modifications can be made to the illustrated embodiments without departing from the spirit of the present disclosure. All such modifications and changes are intended to be covered by the appended claims.

What is claimed is:

1. A dual-purpose container for storing and smoking plant matter, comprising:

a main tubular body having a first end and an opposing second end; the first end having an end wall with an intake orifice therethrough in fluid communication with a smoke chamber; the first end being an inhalation end configured and arranged for fluid communication with a user's mouth; the second end being an open end defining a smokable plant matter chamber with a floor; the second end defining an upstanding wall having an inner surface and an outer surface; an inner rounded lip on the inner surface at the free end of the upstanding wall; the second end being configured and arranged for receiving the smokable plant matter therein and receiving a flame for combustion of the smokable plant matter therein;

a venturi structure disposed through the floor whereby the smokable plant matter chamber and the smoke chamber are in fluid communication with each other; smoke from combustion of the smokable plant matter being inhalable through the first end of the main tubular body;

a cap, having an upper portion having an outer circumferential edge, a lower plug member having an outer circumferential edge and at least one circumferential fin each being a flexible disc-shaped wall, each having an outer circumferential edge and residing between the circumferential edge of the upper portion and the outer circumferential edge of the lower plug member, the outer circumferential edges of the lower plug, the at least one circumferential fin, and the lower plug being in spaced apart relation to each other defining respective gaps therebetween, the rounded inner lip being selectively locatable within one of the gaps to set an associated depth of insertion of the cap into the second open end, whereby the cap is releasably and frictionally engaged with the upstanding wall and the inner lip of the upstanding wall of the second end of the main tubular body;

whereby the cap is installable into the open end of the second end in an indexed and depth adjusted manner thereby selectively sizing the smokable plant matter chamber defined by one of a discrete selectable depths to selectively compress and seal the smokable plant matter residing in the smokable plant matter chamber; the cap being removable from the second end of the main tubular body during combustion of the smokable plant matter.

2. The dual-purpose container for storing and smoking plant matter of claim 1, wherein one circumferential fin is provided on the cap to provide two levels of compression of smokable plant matter.

3. The dual-purpose container for storing and smoking plant matter of claim 1, wherein two circumferential fins are provided on the cap to provide three levels of compression of smokable plant matter.

4. The dual-purpose container for storing and smoking plant matter of claim 1, wherein the venturi structure is configured and arranged to prevent particulate matter from traveling from the smokable plant matter chamber to the smoke chamber.

5. The dual-purpose container for storing and smoking plant matter of claim 1, wherein the smokable plant matter chamber is both a storage chamber for smokable plant matter and a bowl for combusting and smoking smokable plant matter.

6. The dual-purpose container for storing and smoking plant matter of claim 1, further comprising a rolled outer edge residing on the outer surface at a free end of the upstanding wall providing an outer edge seal and the inner lip providing an inner edge seal when the main body is in communication with a heat source.

7. The dual-purpose container for storing and smoking plant matter of claim 6, wherein the rolled outer edge provides mechanical support for holding the dual-purpose container with a support device during loading of smokable plant matter into the smokable plant matter chamber.

8. The dual-purpose container for storing and smoking plant matter of claim 1, wherein the end wall entraps smoke during smoking of the smokable plant matter.

* * * * *